United States Patent [19]

Micallef

[11] 4,020,982

[45] May 3, 1977

[54] ROTARY SHUT-OFF NOZZLE

[75] Inventor: Lewis A. Micallef, Fort Lee, N.J.

[73] Assignee: Leeds and Micallef, Fort Lee, N.J.

[22] Filed: Oct. 10, 1975

[21] Appl. No.: 621,491

[52] U.S. Cl. ..... 222/554; 239/538

[51] Int. Cl.[2] ..... B05B 1/12

[58] Field of Search ..... 222/521, 548, 554; 239/478, 479, 538, 492

[56] References Cited

UNITED STATES PATENTS

| | | | |
|---|---|---|---|
| 1,865,233 | 6/1932 | Campbell | 222/548 X |
| 2,138,992 | 12/1938 | Baker | 222/548 X |
| 3,149,755 | 9/1964 | Porter et al. | 222/548 X |
| 3,204,836 | 9/1965 | Joffe | 222/548 X |

*Primary Examiner*—Robert B. Reeves
*Assistant Examiner*—David A. Scherbel
*Attorney, Agent, or Firm*—Kane, Dalsimer, Kane, Sullivan and Kurucz

[57] ABSTRACT

A multiple purpose nozzle includes a tubular member having a bore and communicating passage network therethrough and through which material to be dispensed is adapted to pass. An adjustable cap is coupled with the tubular member having an orifice in the end wall thereof of predetermined configuration. The cap is coupled to the tubular member so that it may be shifted between shut-off and open positions. In addition the cap is provided with a passage which form part of the passage network when the cap is shifted to the open position. In the closed position the cap passage is not aligned with the passage network of the tubular member and thus prevents the material from being dispensed. The cap is adapted to assume at least one other and open position at which the cap passage is aligned with the passage network and the material to be dispensed is adapted to pass in a selected predetermined discharge pattern through the bore passage network and orifice. The passage network of the tubular member is offset from the orifice of the cap when the cap is adjusted to shut-off position whereby only the orifice in the cap and edge of the tubular member are exposed to atmosphere thereby preventing drying out of the material to be dispensed when the nozzle is not in use.

9 Claims, 6 Drawing Figures

ROTARY SHUT-OFF NOZZLE

BACKGROUND OF THE INVENTION

Products to be dispensed, such as consumer products, are generally contained in a variety of packages. Some are dispensed from squeeze bottles, containers bearing pumps or other product propelling mechanisms. A number of different type of nozzle arrangements are employed with the bottles for various purposes such as protection of the product and protection against damage during shipping, storage and use. Often the type of nozzle employed is dependent upon the material being dispensed in regard to whether the material is viscous in nature or watery and whether the product is to be dispensed in a ribbon-like form of as a stream or spray.

Examples of different types of nozzles which have been found satisfactory for a number of the above purposes include those disclosed in my U.S. Pat. No. 3,843,030 and my pending U.S. Pat. applications Ser. No. 510,580 filed Sept. 30, 1974 now U.S. Pat. No. 3,967,765 granted, July 6, 1976.

One particular area which deserves consideration is in dealing with the dispensing of relatively viscous materials in ribbon form such as lotion or ketchup whether it be dispensed from a squeeze type container or another type of pump mechanism through the nozzle. Occasionally when nozzles are utilized which have discharge paths which are open to atmosphere during non-use periods, the viscous type of material lodged in the exposed passageways will dry out and clog the passageways rendering further dispensing difficult if not impossible. Additionally, it is clearly not aesthetic and could be detrimental to the material or the user to have the initial portion of the viscous material being dispensed in a dried out form.

SUMMARY OF THE INVENTION

With the above background in mind, it is among the principal objectives of the present invention to provide a nozzle for use with a squeeze bottle or other pump type device which is particularly adaptable for use in dispensing viscous fluids. The nozzle arrangement is such that when in an open position the viscous liquid can be freely pumped therethrough for dispensing purposes and when in the closed position there is virtually no liquid exposed to the atmosphere which eliminates the danger of drying out of liquid when the dispenser is not in use. The nozzle is of relatively few parts with each part being individually simple and inexpensive to manufacture and assemble. In this manner, the nozzle cost is maintained at an absolute minimum. Additionally, the nozzle can be shifted between the opened and closed position in a relatively quick, easy and efficient manner.

In summary, the multiple purpose nozzle of the present invention includes a tubular member having a bore therethrough and through which material to be dispensed is adapted to pass. An adjustable cap having an orifice in the end wall thereof of predetermined configuration is associated with the tubular member and is adapted to assume a first position at which it seals off the bore to prevent the material from being dispensed. The cap is adapted to assume at least one other position at which the material to be dispensed is adapted to pass in a selected predetermined discharge pattern through the bore and orifice. Means is on the cap and tubular member to limit the exposure of the amount of fluid to atmosphere when the cap is adjusted to seal the bore thereby preventing drying out of a significant amount of material to be dispensed when the nozzle is not in use. Coupling means is provided for associating the cap with the tubular member whereby the cap may be shifted between the first and other position.

Other objects and advantages will become apparent from the following detailed description of the invention which is to be taken in conjunction with the accompanying drawings.

DESCRIPTION OF THE PREFERRED EMBODIMENT

Figure 1:
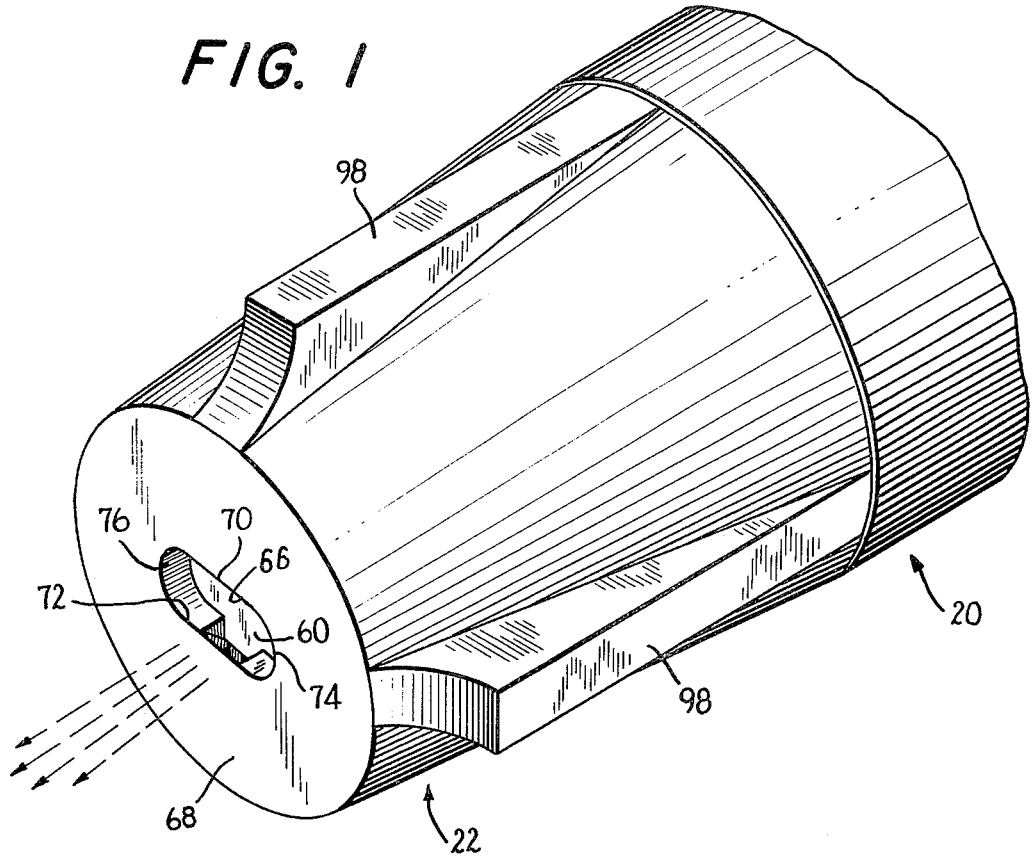
FIG. 1 is a fragmentary perspective view of a multi-purpose nozzle of this invention and showing the nozzle in the open position.

The multi-purpose nozzle illustrated in the drawings is comprised of only two parts, tubular member 20 and cap 22. The tubular member 20 may form part or be an integral extension of the discharge end of a dispenser which may assume any one of a number of varieties, as for example, a pump actuator dispenser, aerosol dispenser or squeeze bottle type of dispenser to mention a few. The nozzle is particularly adapted for use with a dispenser for dispensing a viscous fluid such as a cream lotion or a food product such as ketchup.

Tubular member 20 has a pair of opposed entrance bores 24 and 25 in fluid communication and open to receive fluid from the dispenser at one end and open at the other end to permit passage of fluid through openings 26 and 27 into an annular radial passage 28. The annular radial passage is formed by surfaces on integral extension or boss 32 extending from tubular member 20 and the end wall 34 of the portion of tubular member 20 from which the boss extends in cooperation with inner surfaces on cap 22.

Radial channel 28 communicates with a pair of opposed off-set axial channels 29 and 30 which are formed by cooperating surfaces of the boss 32 and the inner surface of the cap 22. The relative alignment between channels 29 and 30 and radial channel 28 depends upon the position of the cap and they are aligned when the cap is in the open position.

Channel 29 is bounded on one side by wall 36 of the rectangular base portion of boss 32 and on the other side by short axial inner cap wall 38 interconnected with a tapered frusto conical cap wall 40 which terminates near the discharge end of the cap in a radial shoulder 42. The same situation exists on the opposing side of boss 32 where the wall 44 of the rectangular portion of boss 32 forms one side of passage 30 and the opposite side is formed by the interconnection between short axial inner wall surface 46 connected with a longer frusto conical wall surface 48 on the inner surface of cap 22 which terminates near the discharge end of the cap in radial shoulder 50.

When the nozzle is in the open position, channels 29 and 30 communicate with radial channel 28 and accordingly openings 26 and 27 as discussed above and at their opposite ends communicate with a corresponding channel in the forward frusto conical end portion 52 of boss 32. The passageways through the frusto conical portion 52 are diametrically opposed cut-out portions 54 and 56. Each of these cut-out portions are identical in configuration with cut-out 54 communicating with channel 29 and being formed by a radial shoulder 55 on boss 32 extending into a frusto conical portion 58 which terminates at the lateral end wall 60 of boss 32. In corresponding fashion, cut-out 56 is formed by a radial shoulder 62 in the boss which connects with a frusto conical inwardly tapered surface 64 which also terminates at the lateral end wall 60 of the boss.

Figure 2:
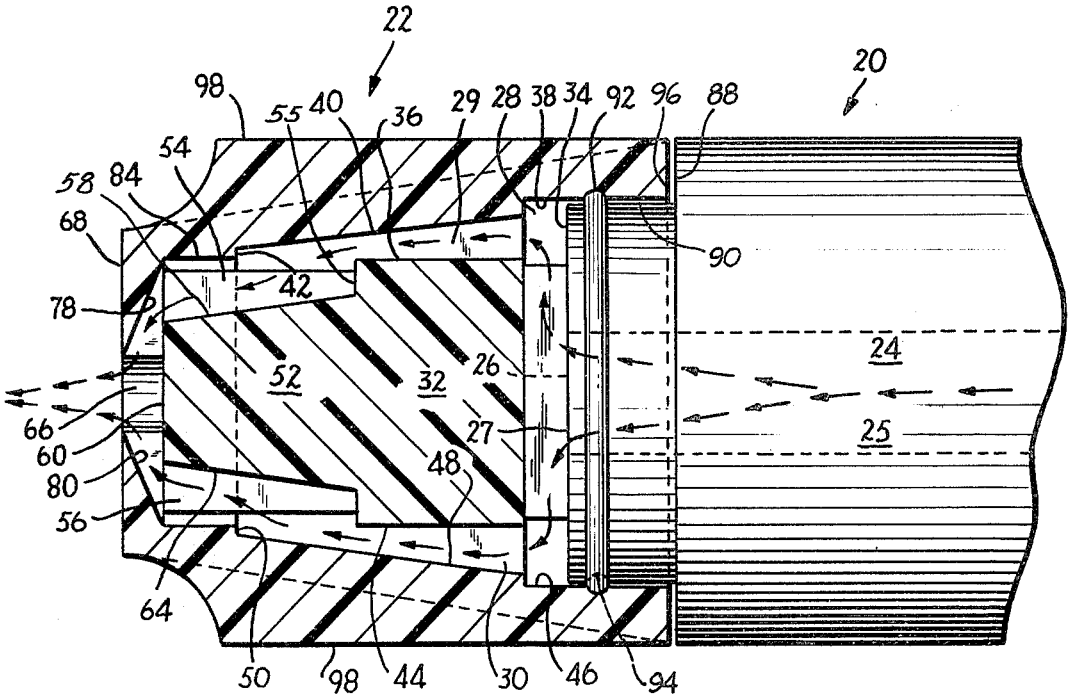
FIG. 2 is a sectional elevation view thereof with arrows showing the path of flow of fluid being dispensed through the nozzle taken along line 2—2 of FIG. 5.
Figure 3:
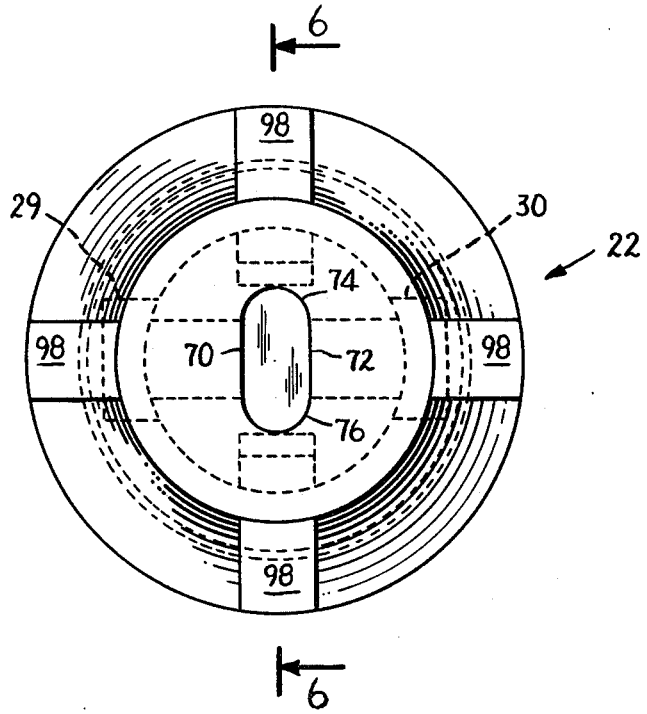
FIG. 3 is an end view thereof in the closed position.
Figure 4:
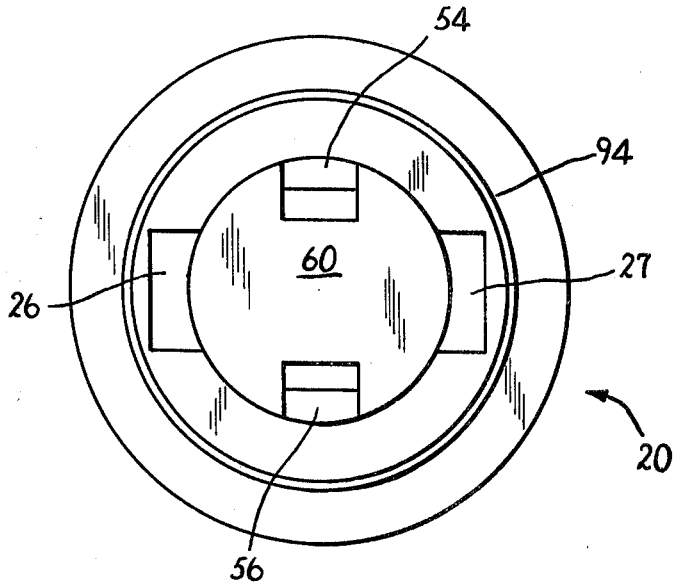
FIG. 4 is an end view thereof with the cap removed.
Figure 5:
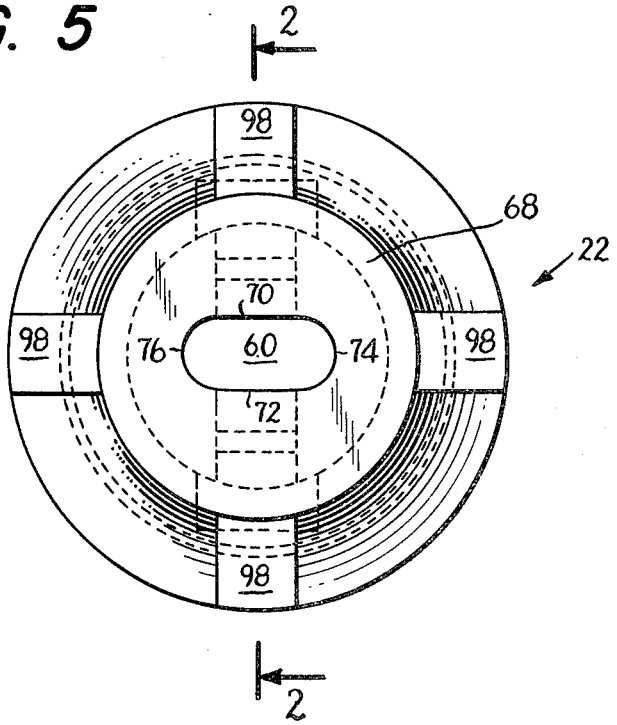
FIG. 5 is an end view thereof in the open position.
Figure 6:
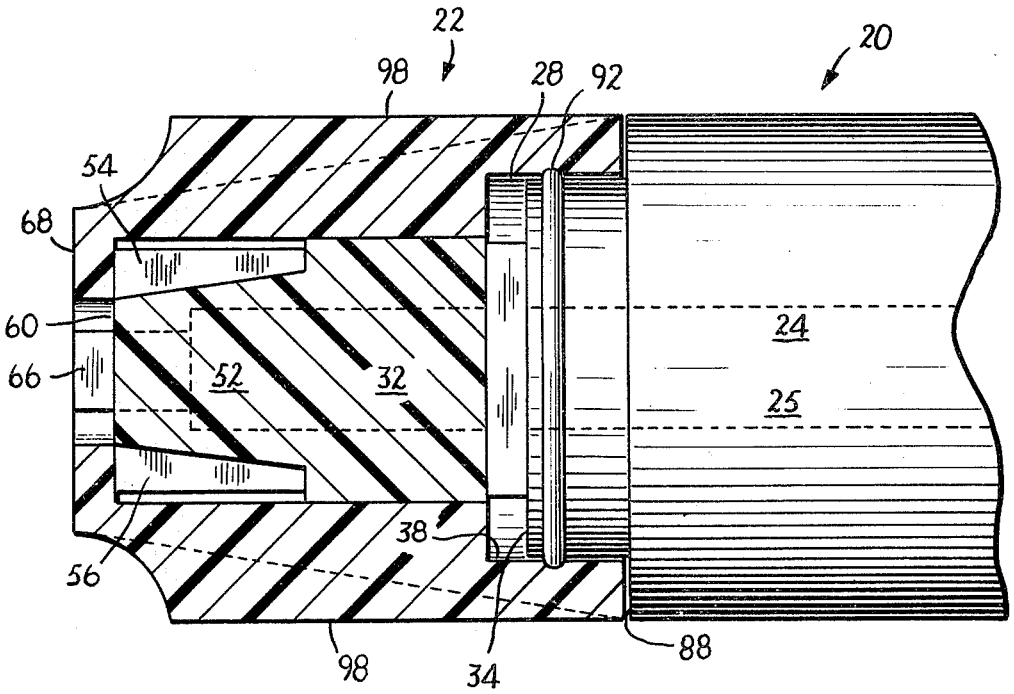
FIG. 6 is a sectional elevation view thereof in the closed position taken along line 6—6 of FIG. 3.

When the nozzle is in the open position, as depicted by the arrows in FIG. 2, fluid flows through channels 26 and 27 and through radial passageway 28 and through opposing off-set channels 29 and 30 and then through cut-outs 54 and 56 and out through a discharge orifice 66 in end wall 68 of the cap 22.

Orifice 66 in the end wall of the cap is oblong in configuration with two longer straight side walls 70 and 72 terminating at either end in an arcuate shorter end wall 74 and 76. In the open position, as shown in FIG. 1–6, the longer axis of orifice 66 is in the horizontal position and the longer side portions 70 and 72 of the orifice are beveled as they extend inwardly through the end wall 68 of the cap. The beveled surfaces 78 and 80 provide communication with cut-outs 54 and 56 respectively when the nozzle is in the open position and the cut-outs are aligned with the beveled surfaces. The beveled surfaces facilitate flow of the viscous liquid through the orifice in the desired manner when the nozzle is in the open position. In this position, as shown in FIG. 2, fluid passes through cut-outs 54 and 56 and out through orifice 66 in the cap. The portion of tubular boss 32 which does not contain cut-outs 54 and 56 at the orifice end of the nozzle forms a tubular wall which mates with a corresponding tubular surface 84 on the inside of the cap adjacent the orifice end to permit relative rotation between the cap and boss and which forms a seal with inner surfaces on the cap when slots 54 and 56 are not in the open position. It engages with the tubular wall surface of the cap at locations where passageways 29 and 30 are not present. Similarly, the longer end wall of boss 32 at the positions where cut-outs 54 and 56 do not exist seal with the inner surface of end wall 68 of the cap to seal the passageways through the nozzle and expose only orifice 66 and the edges of the inner member adjacent to the orifice to atmosphere. Accordingly, fluids contained within cut-outs 54 and 56 and channels 28, 29 and 30 are closed from exposure to atmosphere and accordingly drying out of the fluid contained therein does not occur.

The outer surface of tubular member 20 contains an annular inwardly extending shoulder 88 adjacent the end of the tubular member 20 where the cap is coupled thereto. The inward end of shoulder 88 is integral with an annular reduced receiving neck 90 for interengagement with the open end of cap 22 distal from orifice 66. Adjacent the forward edge of receiving neck 90 which is located at end wall 34 of the tubular member is a circular bead 92 for locking interengagement with cap 22 which is fitted with an accommodating recess 94 on the inner surface thereof and adjacent the open end rim 96 of cap 22. The inner diameter of cap 22 and the outer diameter of neck 90 are dimensioned so that the cap can fit on the neck with bead 92 seated in recess 94. In this position, relative rotation between the cap and interconnected tubular member is permitted.

Cap 24 includes four radial flanges or fins 98 spaced about its outer circumference at approximately 90° intervals. The remainder of the outer surface of the cap tapers from rim 96 gradually to a lesser diameter at the end wall 68 of the cap. As discussed above, the appropriate inner surfaces of the cap 22 provide the necessary channels for dispensing of the fluid and also provide the necessary sealing surfaces when fluid is to be protected from atmosphere and the nozzle retained in the closed position. By spacing the fins 98 at approximately 90° intervals it is possible to use the fins as an indexing means to indicate open and closed positions spaced at the 90° intervals with the two open positions being 180° apart and two closed positions to be spaced 180° apart. Appropriate indicia or coloring can then be placed on the fins to further indicate the open and closed positions.

As discussed above, when the nozzle is placed in the open position by rotation of the cap so as to bring the orifice into alignment with cut-outs 54 and 56 and cut-outs 54 and 56 in alignment with channels 29 and 30 and channels 29 and 30 in alignment with inner passageways 26, 27 and 28, the viscous fluid has a pair of opposed through channels to flow from the tubular member through the nozzle and out of orifice 66. To close flow it is merely necessary to rotate the cap 22 until of the interconnected channels are out of alignment at which time there will be a number of seals formed between orifice 66 and inner passageways 26 and 27. The first seal is between the end wall of boss 32 and the inner surface of end wall 68 of cap 22. The second sealing point is between tubular wall of the boss and a corresponding tubular wall on the inner surface of the cap. A third point of sealing will occur between the tubular wall of the boss and the inner surface wall of the cap where channels 29 and 30 are not located adjacent to radial passageway 28. In this manner, it is possible to positively protect the fluid contents located interiorly of the nozzle from exposure to atmosphere and consequent drying out. Only the orifice surface and sealing edge of the orifice with the inner surfaces is exposed to atmosphere. Naturally, drying of the viscous fluid when the material is as thick as perhaps ketchup or hand lotion affects the future operation of the nozzle since it can clog the passageways, having non aesthetic appearance and could even deleteriously effect the usability of desirability of the dried up viscous fluid.

Rotation of the cap 22 90° in either direction will once again open the interconnected channels and permit fluid flow as shown by the arrows in FIG. 2. Naturally, other angular arrangements can be provided for shifting between the open and closed position in addition to the arrangement shown and described above including different spacing between fins and in the number of fins. Also the number of channels can be varied as a matter of choice. The material for the parts of nozzle 20 can be a commonly used well known plastic or metal material with the choice depending on considerations such as cost and availability.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A multiple purpose nozzle comprising:

a tubular member having an exposed edge, a passageway therethrough and through which material to be dispensed is adapted to pass;

an adjustable cap having an end wall with an orifice of predetermined configuration therein associated with the tubular member and adjacent and touching the exposed edge thereof and adapted to assume a first position at which it seals the passageway from the orifice to prevent the material from being dispensed;

the cap adapted to assume at least one other position at which the material to be dispensed is adapted to pass in a selected predetermined discharge pattern through the passageway and orifice, the exposed edge remaining exposed to atmosphere at all of the positions;

coupling means for associating the cap with the tubular member whereby the cap may be shifted between the first and other position; and means on the cap and tubular member for limiting the exposure of the amount of material to be dispensed to atmosphere when the cap is adjusted to seal the passageway thereby preventing drying of a significant amount of material to be dispensed in the nozzle when the nozzle is not in use, the exposure limiting means including a passage network defined by surfaces of the tubular member and cap that communicates with the orifice of the cap when the cap is in the other position and, when the cap is adjusted to the first position to seal the passageway from the orifice, only the orifice in the cap and exposed edge of the tubular member are exposed to atmosphere thereby preventing drying out of the material to be dispensed when the nozzle is not in use, the passage network including at least one longitudinally extending channel terminating at the exposed edge of the tubular member adjacent the orifice in the cap, channel means adapted to communicate the passageway and the channel with one another, the surfaces forming the channel and channel means being formed by cooperating surfaces on the tubular member and interior surfaces of the cap, rotation of the cap from the first position to the other position aligns the channel with the orifice to permit communication between the passage network and the orifice and flow of material to be dispensed therethrough from the passageway of the tubular member and rotation of the cap to the first position interrupts the passage network and blocks the flow of material from the passageway to the orifice through the passage network.

2. The invention in accordance with claim 1, wherein each of the channels which terminate at the orifice are narrow in width and are approximately diametrically opposed from one another, the surfaces on the boss of the tubular member forming each channel including an axially extending portion toward the orifice terminating in a radially inwardly extending shoulder which terminates in a frusto-conical surface tapering inwardly toward the end thereof at the location of the orifice, the corresponding aligned inner surface of the cap beginning with a frusto conical tapering surface extending from alignment with the beginning portion of the axial surface of the boss and terminating intermediate the ends of the frusto conical surface of the boss with an inwardly extending radial shoulder, the inward end of the shoulder connected to an axial portion of the inner wall terminating at the end wall of the cap, the remainder of the boss being substantially cylindrical in configuration and terminating in a lateral end wall, the edge of which is in sealing engagement with the end wall of the cap, the remainder of the inner surface of the cap being cylindrical in shape to provide sealing interengagement between the cap and boss and close the passage network when the surfaces on the cap and tubular member forming the passage network are not aligned.

3. A multiple purpose nozzle comprising:

a tubular member having an exposed edge, a passageway therethrough and through which material to be dispensed is adapted to pass;

an adjustable cap having an end wall with an orifice of predetermined configuration therein associated with the tubular member and adjacent the exposed edge thereof and adapted to assume a first position at which it seals the passageway from the orifice to prevent the material from being dispensed;

the cap adapted to assume at least one other position at which the material to be dispensed is adapted to pass in a selected predetermined discharge pattern through the passageway and orifice;

coupling means for associating the cap with the tubular member whereby the cap may be shifted between the first and other position; and means on the cap and tubular member for limiting the exposure of the amount of material to be dispensed to atmosphere when the cap is adjusted to seal the passageway thereby preventing drying of a significant amount of material to be dispensed in the nozzle when the nozzle is not in use, the exposure limiting means including a passage network defined by surfaces of the tubular member and cap that communicates with the orifice of the cap when the cap is in the other position and, when the cap is adjusted to the first position to seal the passageway from the orifice, only the orifice in the cap and exposed edge of the tubular member are exposed to atmosphere thereby preventing drying out of the material to be dispensed when the nozzle is not in use, the passageway in the tubular member being a pair of spaced passages in the rearward portion of the tubular member, a boss extending from the forward end and forming part of the tubular member, passage network including a radially extending channel communicating with the passages at one end and terminating in two opposed longitudinally extending channels at the other end, the longitudinal channels terminating adjacent the orifice in the cap, the surfaces forming the radially extending and longitudinally extending channels being formed by surfaces on the boss and the tubular member in cooperation with interior surfaces on the cap, the orifice in the cap being oblong in configuration so as to have a longer longitudinal dimension and a shorter lateral dimension whereby rotation of the cap with respect to the tubular member to bring the longitudinal dimension of the orifice and the longitudinal channels into alignment will permit communication between the passage network and orifice and flow of material to be dispensed therethrough from the passageway of the tubular member and rotation of the cap to the first position interrupts the passage network and blocks and flow of material from the passageway to the orifice through the passage network.

4. The invention in accordance with claim 3 wherein a 90° rotation in either direction is necessary to shift the nozzle between the open and closed position.

5. The invention in accordance with claim 3 wherein each of the channels which terminate at the orifice are narrow in width and are approximately diametrically opposed from one another, the surfaces on the boss of the tubular member forming each channel including an axially extending portion toward the orifice terminating in a radially inwardly extending shoulder which terminates in a frusto conical surface tapering inwardly toward the end thereof at the location of the orifice, the corresponding aligned inner surface of the cap beginning with a frusto conical tapering surface extending from alignment with the beginning portion of the axial surface of the boss and terminating intermediate the ends of the frusto conical surface of the boss with an inwardly extending radial shoulder, the inward end of the shoulder connected to an axial portion of the inner wall terminating at the end wall of the cap, the remainder of the boss being substantially cylindrical in configuration and terminating in a lateral end wall, the edge of which is in sealing engagement with the end wall of the cap, the remainder of the inner surface of the cap being cylindrical in shape to provide sealing interengagement between the cap and boss and close the passage network when the surfaces on the cap and tubular member forming the passage network are not aligned.

6. The invention in accordance with claim 3 wherein the longer longitudinal sides of the oblong orifice being tapered outwardly as they extend through the end wall of the cap to the interior thereof to facilitate communication with the channels when in the open position and enhance flow of fluid through the nozzle orifice.

7. The invention in accordance with claim 3 wherein the nozzle is adapted to be mounted on a squeeze bottle dispenser.

8. The invention in accordance with claim 3 wherein the material to be dispensed through the nozzle is dispensed in a ribbon of viscous material.

9. The invention in accordance with claim 3 wherein four longitudinal fins are positioned on the outer surface of the cap at approximately 90° intervals to facilitate indication of the open and closed positions of the nozzle and to facilitate gripping and rotation of the cap with respect to the tubular member.

* * * * *